US006772447B2

(12) United States Patent
Morrow et al.

(10) Patent No.: US 6,772,447 B2
(45) Date of Patent: Aug. 10, 2004

(54) PROTECTIVE SPORT HELMET

(75) Inventors: David Morrow, Farmington Hills, MI (US); David Falge, Kirkville, NY (US); Kevin Morrow, Warren, MI (US)

(73) Assignee: Stryke Lacrosse, Inc., Warren, MI (US)

( * ) Notice: Subject to any disclaimer, the term of this patent is extended or adjusted under 35 U.S.C. 154(b) by 0 days.

(21) Appl. No.: 10/232,023

(22) Filed: Aug. 30, 2002

(65) Prior Publication Data

US 2004/0040073 A1 Mar. 4, 2004

(51) Int. Cl.[7] ..... A42B 1/08
(52) U.S. Cl. ..... 2/424; 2/414; 2/425
(58) Field of Search ..... 2/9, 421, 424, 2/425, 411, 414

(56) References Cited

U.S. PATENT DOCUMENTS 3,783,450 A * 1/1974 O'Connor ..... 2/421
4,837,866 A * 6/1989 Rector et al. ..... 2/424
4,933,993 A * 6/1990 McClelland ..... 2/424
RE34,699 E * 8/1994 Copeland et al. ..... 2/419
5,666,670 A * 9/1997 Ryan et al. ..... 2/425
5,915,537 A * 6/1999 Dallas et al. ..... 2/410
5,953,761 A * 9/1999 Jurga et al. ..... 2/425
6,073,272 A * 6/2000 Ball ..... 2/423
6,079,053 A * 6/2000 Clover et al. ..... 2/424
6,292,954 B1 * 9/2001 O'Bradaigh et al. ..... 2/424

* cited by examiner

*Primary Examiner*—Rodney M. Lindsey
(74) *Attorney, Agent, or Firm*—Artz & Artz, PC

(57) ABSTRACT

A protective sport helmet, such as for lacrosse includes a hard shell portion. The hard shell portion is constructed so as to provide protection to a wearer's head. The inner side of the hard shell portion includes a lining portion that is secured thereto. A chin strap portion is includes for attachment to the hard shell portion at a plurality of attachment points. The hard shell portion includes a ledge portion that extends generally forwardly therefrom. A visor portion is secured to the hard shell portion and overlies the ledge portion. A facemask portion is secured to both the hard shell portion and the ledge portion in order to improve the structural integrity of the helmet.

14 Claims, 5 Drawing Sheets

PROTECTIVE SPORT HELMET

TECHNICAL FIELD

The present invention relates generally to a protective helmet, and more particularly to a protective sport helmet for use in the game of lacrosse.

BACKGROUND OF THE INVENTION

Helmets for use in a variety of different sporting events, as well as for a variety of different recreational activities, are well known. The known primary purpose of these helmets is to protect a wearer's head from injury in the event that a force is directed thereat. Thus, a principal objective of helmets for use in any activity or sport is user safety. In fact, government and/or other standards exist that govern the performance of helmets intended for certain activities when subjected to certain forces.

Helmets used by those engaged in certain sports typically have a hard outer shell that covers some type of energy-absorbing material. The hard outer shell of most sport helmets is typically comprised of a plastic material. The outer shell typically covers an expanded inner layer that lies between the outer shell and the wearer's head. The inner layer is intended to absorb energy in the event it becomes necessary in order to minimize the energy transmitted to a wearer's head. One known material for inner layers is polystyrene, which absorbs energy by developing multiple micro-fractures throughout its structure. However, once a polystyrene helmet develops micro-fractures it ceases to provide impact protection (i.e., such helmets are unusable after a single impact).

Football helmets, for example, typically have a dense polyethylene outer shell that covers polypropylene pads capable of absorbing multiple impacts. Other helmets, such as those used by soldiers, typically have a metal or composite shell; that is able to protect a soldier's head from certain types of high-energy impacts.

It is also well known, that current protective helmets do not provide a high degree of comfort. This is principally because the helmet itself and the inner lining are designed principally for safety purposes and not for comfort. As such they can be relatively heavy and cumbersome. Moreover, in order to provide sufficient safety and protection, many helmets forgo certain functional features that may be desirable in certain activities.

Helmets also typically have a retention system to secure the helmet in proper position on the user's head. The straps commonly used for typical sport helmets are difficult to adjust, resulting in the helmets being improperly positioned and, thus, providing limited protection. Moreover, the straps can also cause discomfort for the user's chin as well as limiting the range of motion of a wearer's head.

It would thus be desirable to provide a helmet that provides an appropriate balance between user safety and user comfort.

SUMMARY OF THE INVENTION

It is therefore an object of the present invention to provide a protective sport helmet that provides improved comfort to a wearer as compared to current protective helmets.

It is a related object of the present invention to provide a protective helmet for use in the game of lacrosse that is more comfortable than current lacrosse helmets.

It is another object of the present invention to provide a protective helmet that is more durable and has increased strength as compared to current protective helmets.

It is a further object of the present invention to provide a protective helmet that allows for increased range of motion for a chin strap and thus improved fit and comfort to a wearer as well as increased safety.

It is still another object of the present invention to provide a protective helmet that allows for improved peripheral vision for a wearer.

It is yet another object of the present invention to provide a protective helmet that allows for better hearing capabilities while the helmet is being worn.

It is still a further object of the present invention to provide a protective sport helmet with increased ventilation.

It is yet a further object of the present invention to provide a protective helmet that creates less noise than current helmet design.

It is still yet a further object of the present invention to provide a protective helmet that provides improved protection to the back or base of a wearer's neck during use.

It is still yet another object of the present invention to provide a protective helmet than can be easily modified to accommodate heads of varying sizes.

In accordance with the above and other objects of the present invention, a protective sport helmet is provided. The helmet is intended for use in contact sports, such as lacrosse, and includes a hard shell portion. The hard shell portion is constructed so as to provide protection to a wearer's head. The inner side of the hard shell portion includes a lining portion that is secured thereto. A chin strap portion is included for attachment to the hard shell portion at a plurality of attachment points. The hard shell portion includes a ledge portion that extends generally forwardly therefrom. A visor portion is secured to the hard shell portion and overlies the ledge portion. A facemask portion is secured to both the hard shell portion and the ledge portion in order to improve the structural integrity of the helmet.

In accordance with another object of the present invention, the helmet includes raised chin strap attachment points that allow the straps to rotate thereon, while remaining attached to increase the range of motion of a wearer's head. The helmet further includes three elongated ear holes to improve ventilation as well as to allow the wearer to hear better during use. Additionally, the helmet includes an inner lining having a removable portion that allows the helmet to be easily sized for different wearers. The inner lining includes a laminate layer in contact with the wearer's head that provides moisture management/wicking characteristics.

Other advantages of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
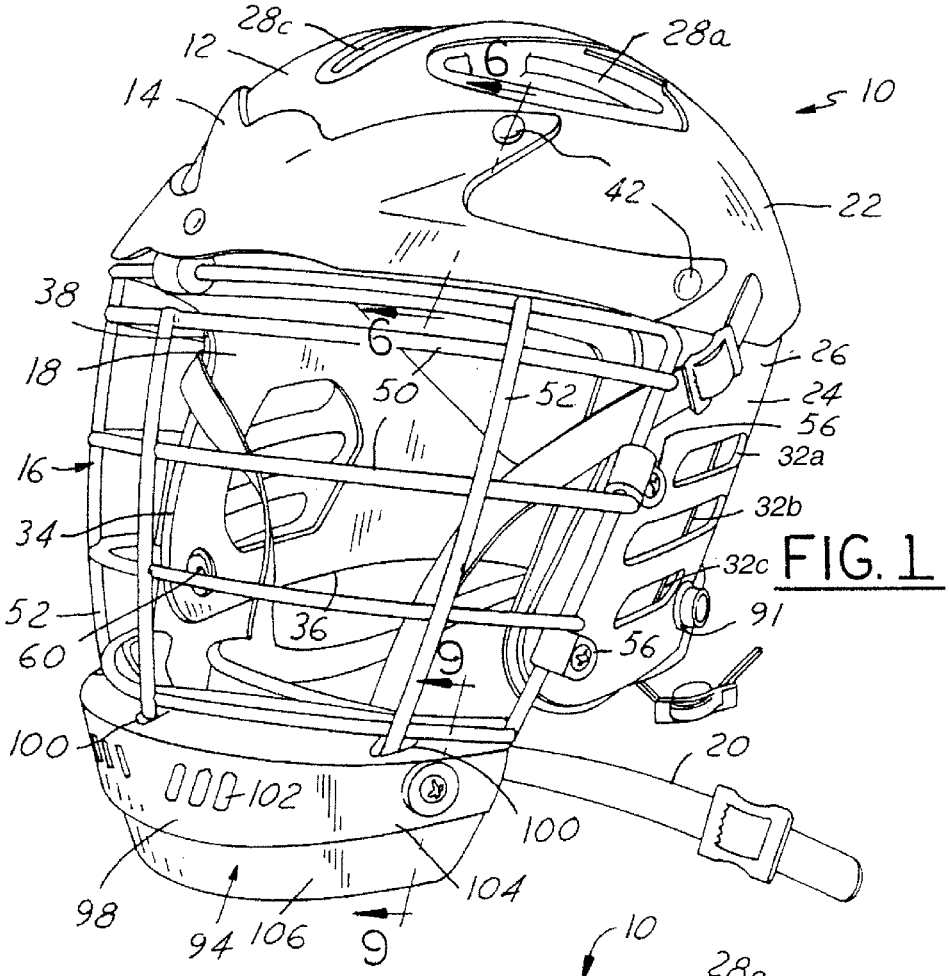
FIG. 1 is a perspective view of a protective helmet in accordance with a preferred embodiment of the present invention.

Referring to the Figures, a protective helmet 10 in accordance with the present invention is illustrated. The protective sport helmet is preferably intended for use in the game of lacrosse. However, it will be understood that the helmet 10 may be utilized in or adapted for use in a variety of other sports, including field hockey, ice hockey or other sports where protection for a wearer's head is desired or required. Moreover, it will be further understood that the disclosed helmet 10 can be utilized in or adapted for use in a variety of other activities, including recreational activities where protection for a wearer's head is desired or required.

Referring now to FIGS. 1 through 5, a protective helmet 10 in accordance with a preferred embodiment of the present invention is illustrated. The protective helmet 10 includes an outer shell 12, a visor portion 14, a face mask 16, an inner lining 18, and a chin strap portion 20.

The outer shell 12 is preferably integrally formed as a single unitary piece. The outer shell 12 is preferably comprised of a hard plastic material and is formed from conventional injection molding process. Specifically, the outer shell 12 is preferably formed of polyurethane. It will be understood that the outer shell 12 may be comprised of a variety of other materials and may be formed from other processes. However, the outer shell 12 must be formed of a material and by a process that provides sufficient hardness and force resistant characteristics, as would be understood by one of skill in the art.

The hard outer shell 12 preferably has an upper crown portion 22 and a lower portion 24. The upper crown portion 22 is intended to cover the crown of a wearer's head, as is discussed in more detail below. The lower portion 24 is intended to cover the back and sides of a wearer's head. A ridge 26 is preferably formed at the connection of the upper crown portion 22 and the lower portion 24. The ridge 26 is formed as a result of the upper crown portion 22 being thicker than the lower portion 24. Accordingly, the exact configuration and location of the ridge 26 is not critical. Moreover, the thickness of the upper crown portion 22 and the lower portion 24 may obviously vary.

The upper crown portion 22 also includes a plurality of vent openings 28 formed therein. One set of vent openings 28*a* is preferably located generally on one side of the upper crown portion 22, one set of vent openings 28*b* is located generally on the opposing side of the upper crown portion 22, and one set of vent openings 28*c* is located generally in the middle or top of the upper crown portion 22. The location and configuration of the vent openings 28, as well as the number of openings and groupings thereof, is a matter of design choice and is thus not a critical part of the invention. The upper crown portion 14 further includes a forwardly extending ledge portion 30. The forwardly extending ledge portion 30 is preferably an integral part of the helmet 10.

The lower portion 24 of the helmet 10 has a plurality of ear holes 32 formed in either side thereof. The ear holes 32 are preferably generally elongated and lie one above the other in a generally parallel stakcing configuration. Current lacrosse helmets, such as those commercially available from Cascade or Sport Helmets have only one or two ear holes on either side of the helmet. The disclosed helmet 10 preferably has three ear holes 32 formed in each side of the helmet 10, which allows for increased communication on the field as well as for increased ventilation to the wearer's head. Moreover, the ear holes 32 are narrower (top to bottom) than ear holes in current heads. As shown, the upper ear hole 32*a* and the lower ear hole 32*c* have generally the same shape. Moreover, the upper ear hole 32*a* is preferably located further rearward than the lower ear hole 32*c*. The middle ear hole 32*b* is preferably longer (back to front) than both the upper ear hole 32*a* and the lower ear hole 32*b*.

Additionally, the lower portion 24 of the outer shell 12 has a forward edge 34 which extends from a bottom edge 36 of the helmet 10 to the forwardly extending ledge portion 30. The forward edge 34 is preferably configured such that it extends generally rearward from the bottom edge 36 to the ledge portion 30. In other words, the top end 38 of the forward edge 34 adjacent the ridge 26 or the ledge portion 30 is located more rearward than the bottom end 40 adjacent the bottom edge 36. This cut back feature allows better visibility for a wearer as their eyes are intended to be located in the helmet 10 adjacent the top end 38. Accordingly, a wearer will have increased peripheral vision as compared to current helmets.

Figure 6:
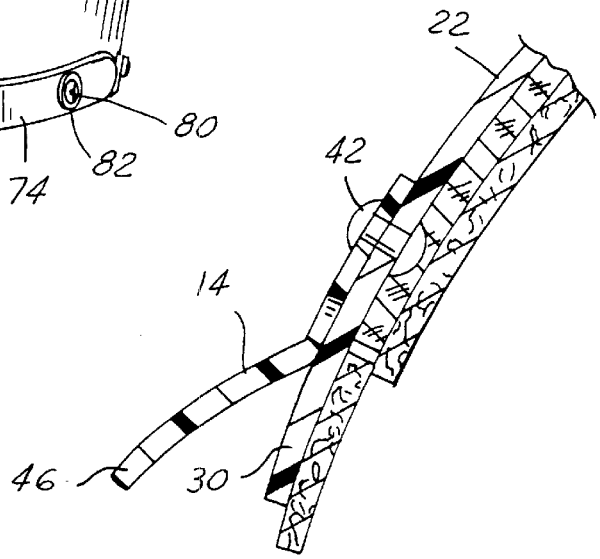
FIG. 6 is a cross-sectional view of the attachment of a visor portion to the protective helmet of FIG. 1 in the direction of the arrows labeled 6—6.

The visor portion 14 of the helmet 10 is preferably a separate piece that is attached to the helmet. As shown best in FIG. 6, in the preferred embodiment, the visor portion 14 is attached to the upper crown portion 22. More preferably, the visor portion 14 is secured to the upper crown portion 22 by four attachment points 42. It will be understood that more or less attachment points 42 may be incorporated into the helmet 10. Moreover, the visor portion 14 may take on a variety of different configurations.

Figure 7:
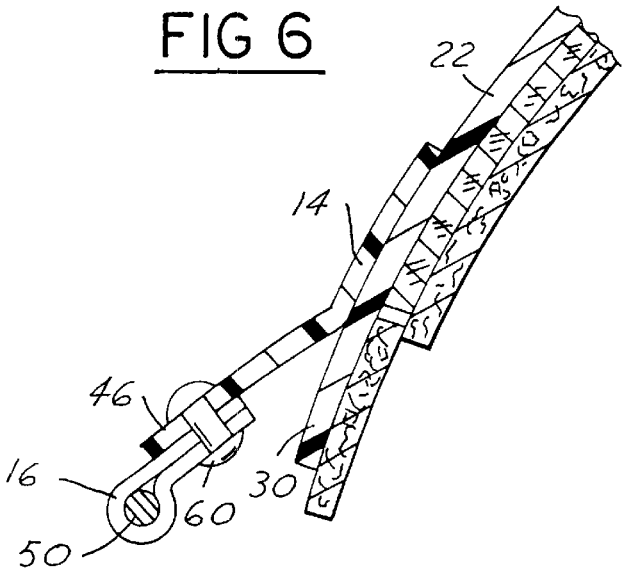
FIG. 7 is a cross-sectional view of the attachment of the facemask to the protective helmet of FIG. 3 in the direction of the arrows labeled 7—7.

Additionally, as shown best in FIG. 7, the visor portion 14 overlies the forwardly extending ledge portion 30. The visor portion 14 preferably includes an overhang portion 46 that extends over the ledge portion 30 in order to help retain the visor portion 14 in a secure position. It will be understood that the visor portion 14 can also be secured directly to the ledge portion 30. The visor portion 14 is preferably also formed of a plastic material, but is preferably formed from compression molding techniques. It will be understood that the visor portion 14 may be formed from other materials and by other processes.

The face mask or cage portion 16 of the helmet 10 is intended to cover the front opening of the helmet 10 and protect a wearer's face. The face mask 16 includes a plurality of horizontal bars 50 and a plurality of vertical bars 52. The horizontal bars 50 and the vertical bars 52 form a plurality of openings 54 therein to allow line of sight for a wearer of the helmet 10. The face mask 16 is preferably constructed of a metal, however, it may be constructed of a variety of other suitable materials. The face mask 16 is mounted such that the upper most horizontal bar 50 is planar and almost contacts the forwardly extending ledge portion 30. The provides additional safety for the wearer of the helmet 10. As can be seen, the face mask 16 has an outermost portion that is disposed outwardly (forwardly away from a wearer's face) with respect to the visor portion 14. The will assist in preventing any of the wearer's equipment from getting caught in the visor portion 14.

The face mask 16 is preferably attached directly to the helmet 10. This is contrary to current helmet configurations that have at least one attachment portion that secures the face mask 16 to a visor portion 14 and includes only one attachment portion on either side of the helmet opening. The attachment to the visor portion 14 can cause instability as well as premature failure. Additionally, the attachment of the face mask 16 to the visor portion 14 can cause increase rattling during use and generate unwanted noise for the wearer.

Accordingly, the disclosed helmet 10 preferably employs a five point attachment system of the face mask 16 to the helmet 10. As shown, two of the attachment points 56 are located on one side of the helmet 10 adjacent the forward edge 34. Another two of the attachment points 58 are located on the opposing side of the helmet 10 adjacent the opposing forward edge 34. The fifth attachment point 60, as best shown in FIG. 7, secures the face mask 16 to the underside of the forwardly extending ledge portion 30. It will be understood that more or less attachment points may be utilized. However, the preferred attachment system secures the face mask 16 to the helmet, which results in a more structurally sound and stronger helmet. The preferred attachment system also reduces unwanted noise due to rattling of connected pieces.

Figure 11:
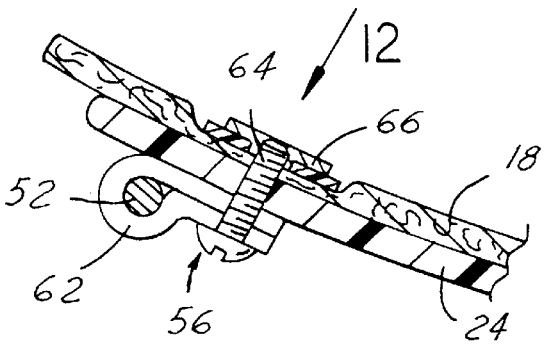
FIG. 11 is a cross-sectional view of the attachment of the facemask to the helmet of FIG. 3 in the direction of the arrows labeled 11—11.
Figure 12:
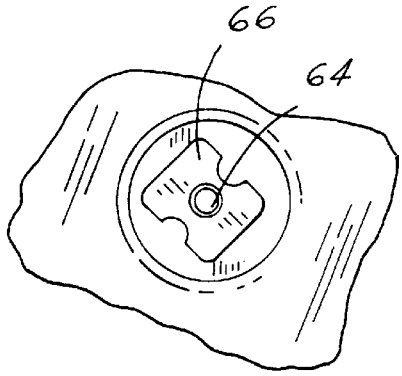
FIG. 12 is a view of the attachment mechanism of FIG. 11 in the direction of the arrow labeled 12.

FIGS. 11 and 12 illustrate a representative attachment point 56. It will be understood that the configuration of the attachment points 58 will appear substantially the same as the attachment points 56 and thus need not be separately illustrated. As shown, a vertical bar 52 is housed within a connector portion 62. The connector portion 62 is secured to the helmet 10 by a screw 64 or other suitable attachment mechanism. A nut 66 is located inside the helmet 10 and is in communication with the screw 64 to prevent the screw 64 from becoming detached from the helmet 10. It will be understood that the attachment points can take on a variety of different configurations.

Figure 13:
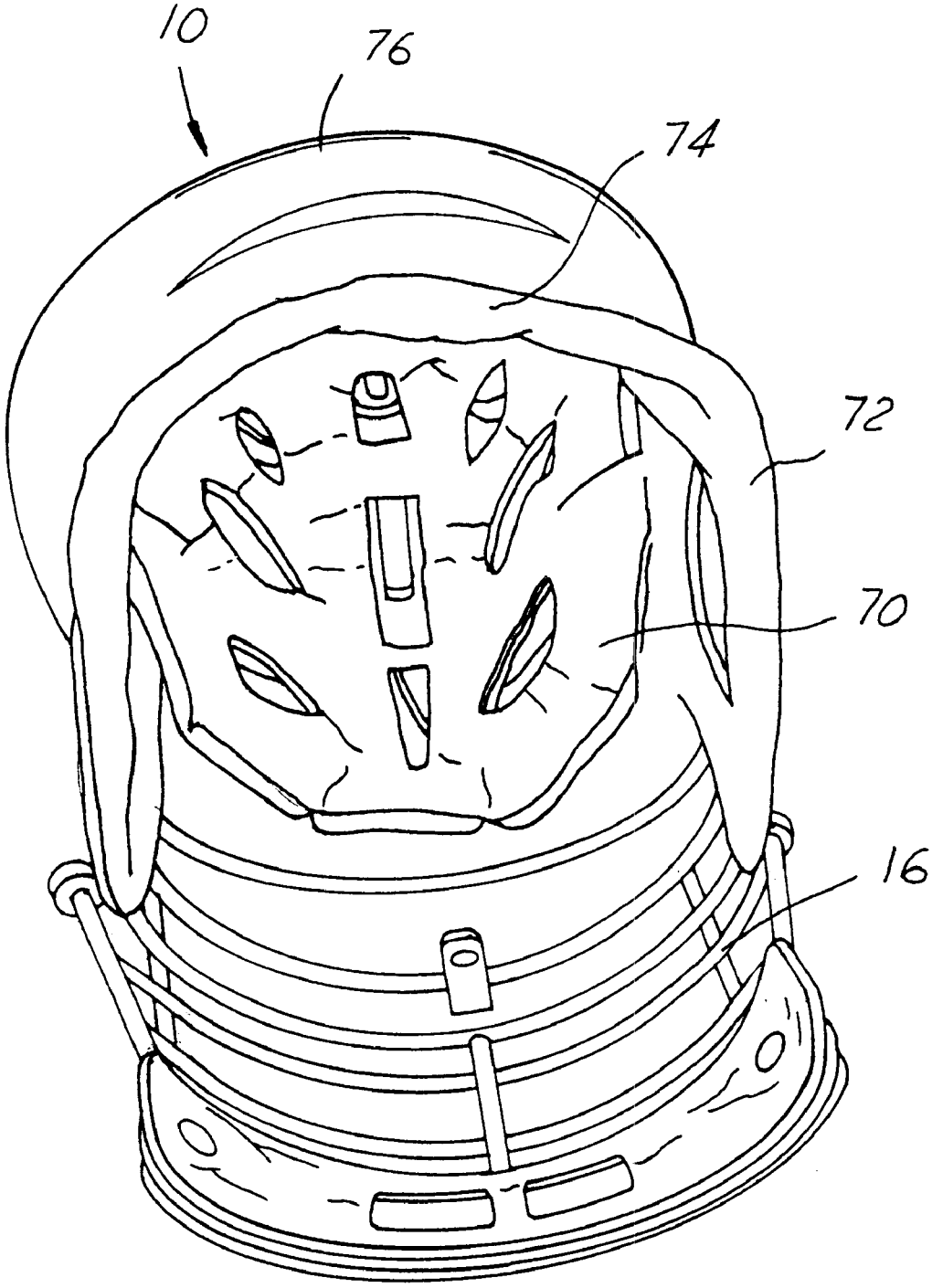
FIG. 13 is a bottom view of a protective helmet in accordance with a preferred embodiment of the present invention.

As set forth above, the helmet 10 includes an inner lining 18 that is attached to an inner surface of the outer shell. While the inner lining 18 is preferably secured to the inside of the outer shell 12, it does not cover the plurality of vent openings 28*a*, 28*b*, 28*c*, as best shown in FIG. 13. Similarly, the inner lining 18 does not cover the ear holes 32*a*, 32*b*, 32*c*, as best shown in FIGS. 1 and 13. The inner lining 18 is preferably constructed of two separate layers.

In the preferred embodiment, the first (outermost) layer is the layer that is in direct contact with the outer shell 12. The outermost layer is preferably constructed of vinyl nitrol. The vinyl nitrol layer provides a hard layer in contact with the outer shell 12 to provide further protection for a wearer's head. It will be understood that other suitable materials with desired hardness may be utilized. The second layer, which is the layer closest to a wearer's head, is preferably a laminate lining. The second layer is preferably secured to and overlies the first layer. The preferred laminate lining is Bucktex®, which is a relatively soft and non-abrasive material and thus provide significant comfort to a wearer. Bucktex® is a registered trademark of Sonatex, Inc of Canada.

Additionally, the Bucktex® is intended to prevent a wearer's hair from catching thereon. The inner lining 18 is thus soft and provides more comfort to a user than current helmet liners. The Bucktex® is also preferably a moisture management/wicking material that helps keep the wearer's head cool and dry. It will be understood that the second layer could be constructed of a variety of other suitable materials that are soft and non-abrasive and have moisture management/wicking characteristics.

The inner liner 18 preferably includes a crown layer portion 70 and a lower liner portion 72. As best shown in FIG. 13, the crown layer portion 70 is preferably attached to the portion of the helmet 10 that generally corresponds to the upper crown portion 22. The crown layer portion 70 preferably consists of the laminate liner and is preferably removably attached to the interior of the outer shell 10. This allows crown layer portion 70 of different thicknesses to be inserted therein. By this removable crown layer portion 70, the helmet 10 can be adjusted to fit a wide variety of sizes without having to make major adjustments to the configuration or shape of the helmet 10. The removable crown layer portion 70 is preferably retained within the helmet 10 to the first layer by known hook and loop attachment or other suitable attachment mechanism.

The lower lining portion 72 is preferably secured to the portion of the helmet 10 corresponding to the lower portion 24. The lower lining portion 72 preferably extends around the cut out ear holes 32*a*, 32*b*, 32*c* in order to provide maximum comfort to a wearer. In other words, the lower lining portion 72 wraps around the ear holes 32*a*, 32*b*, 32*c*. Additionally, as shown best in FIGS. 2 and 5, the lower lining portion 72 has an end portion 74 that wraps around the bottom edge 36 of a back side 76 of the helmet 10. The end portion 74 is secured to the outer shell 12. The lower lining portion 72 thus covers the bottom edge 36 at the back side 76 of the helmet 10. This provides added protection to the base of a wearer's neck. Current helmets can harm a wearer's neck if their head snaps back quickly due to direct skin contact with the bottom edge of the helmet.

Figure 8:
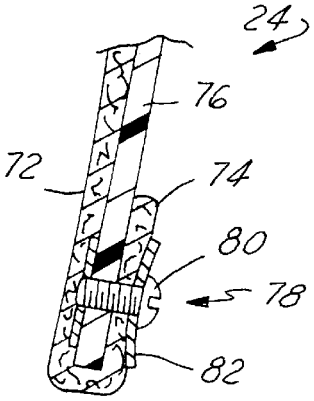
FIG. 8 is a cross-sectional view of the attachment of a rear portion of the helmet lining to the outer side of the helmet of FIG. 6 in the direction of the arrows labeled 8—8.

Referring now to FIG. 8, which illustrates the attachment of the end portion 74 to the lower portion 24 of the outer shell 12. As set forth above, the end portion 74 wraps around the bottom edge 36 and is secured at a plurality of attachment points 78. Each of the attachment points 78 is preferably constructed of a screw 80 with a washer 82 located between the head of the screw 80 and the end portion 74. It will be understood that any conventional securing mechanism can be utilized. Moreover, the number of attachment points 78 can vary.

The helmet 10 also includes a chin strap portion 20, which is preferably comprised of a chin guard 86 and a plurality of chin straps 88 that attach to the helmet 10. The configuration of the straps 88 is well known. The plurality of straps 88 attach to the helmet at a respective pivot chin strap attachment point 90. As shown, each of the respective pivot chin strap attachment points 90 is raised with respect to the surface of the outer shell 12. More specifically, the helmet 10 is formed with a plurality of raised nubs 91, which are preferably formed during the molding process. A snap or other attachment mechanism is secured to each of the nubs 91. This raised attachment of the straps 88 to the pivot chin strap attachment points 90 allows for increased range of motion for the chin straps 88. This provides increased comfort for the wearer of the helmet 10. Additionally, this raised attachment assists in keeping the chin in a neutral position and upon impact keeps the jaw in a neutral position to minimize the chance of a concussion.

Figure 2:
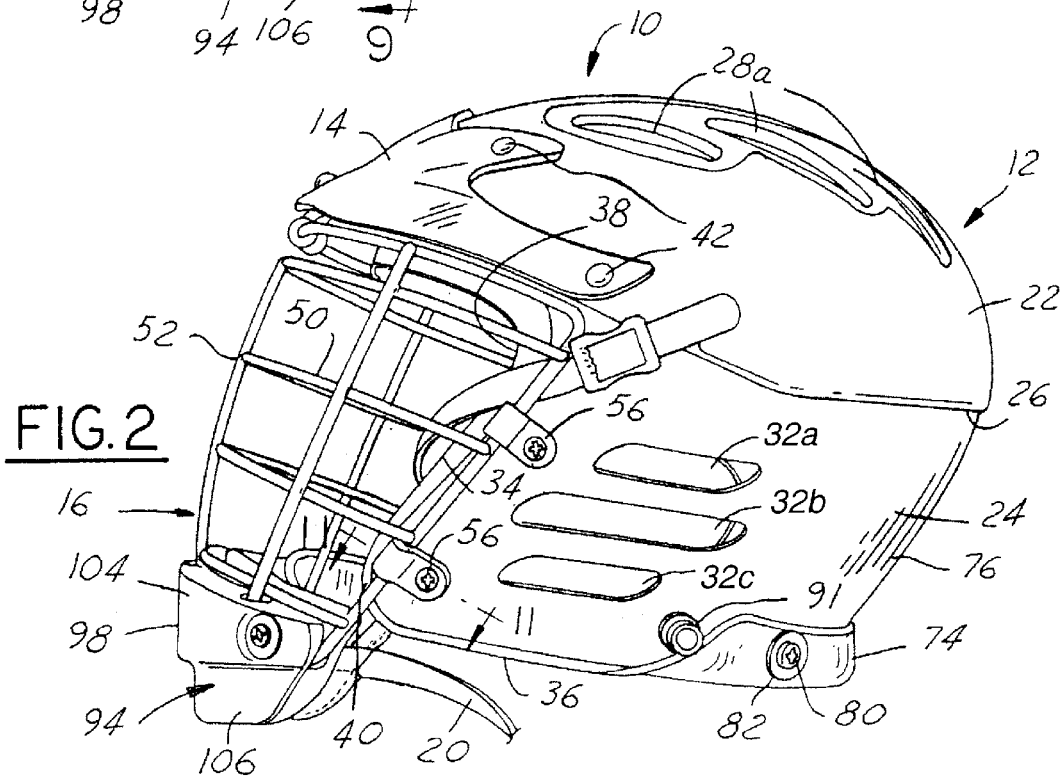
FIG. 2 is a side view of a protective helmet in accordance with a preferred embodiment of the present invention.
Figure 3:
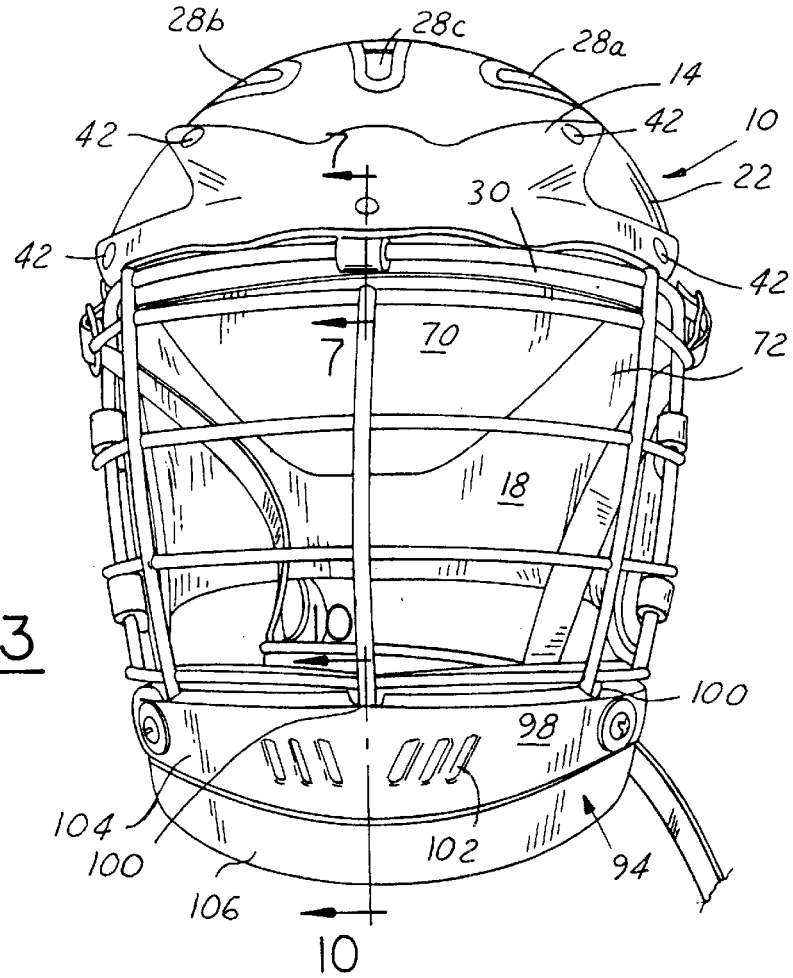
FIG. 3 is a front view of a protective helmet in accordance with a preferred embodiment of the present invention.
Figure 4:
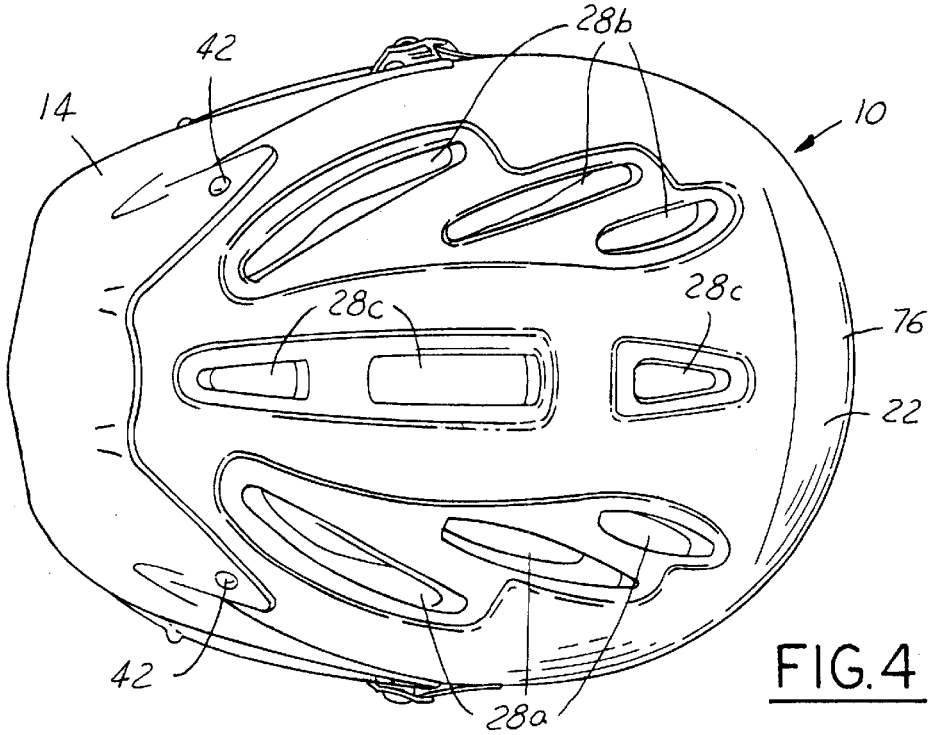
FIG. 4 is a top view of a protective helmet in accordance with a preferred embodiment of the present invention.
Figure 5:
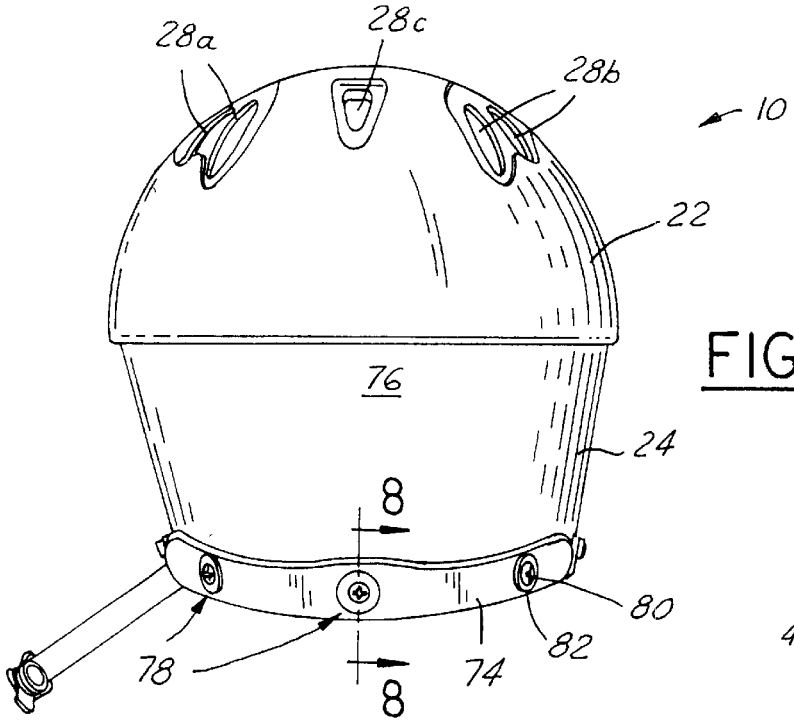
FIG. 5 is a rear view of a protective helmet in accordance with a preferred embodiment of the present invention.
Figure 9:
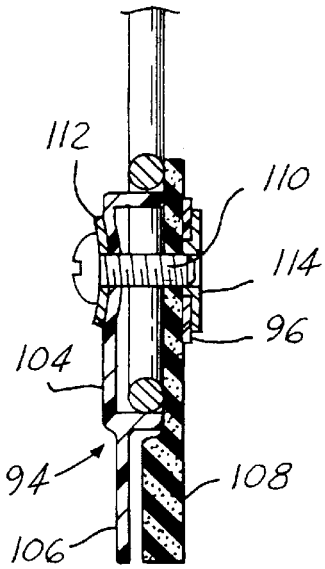
FIG. 9 is a cross-sectional view of the attachment of the mouthpiece to the facemask of FIG. 1 in the direction of the arrows labeled 9—9.
Figure 10:
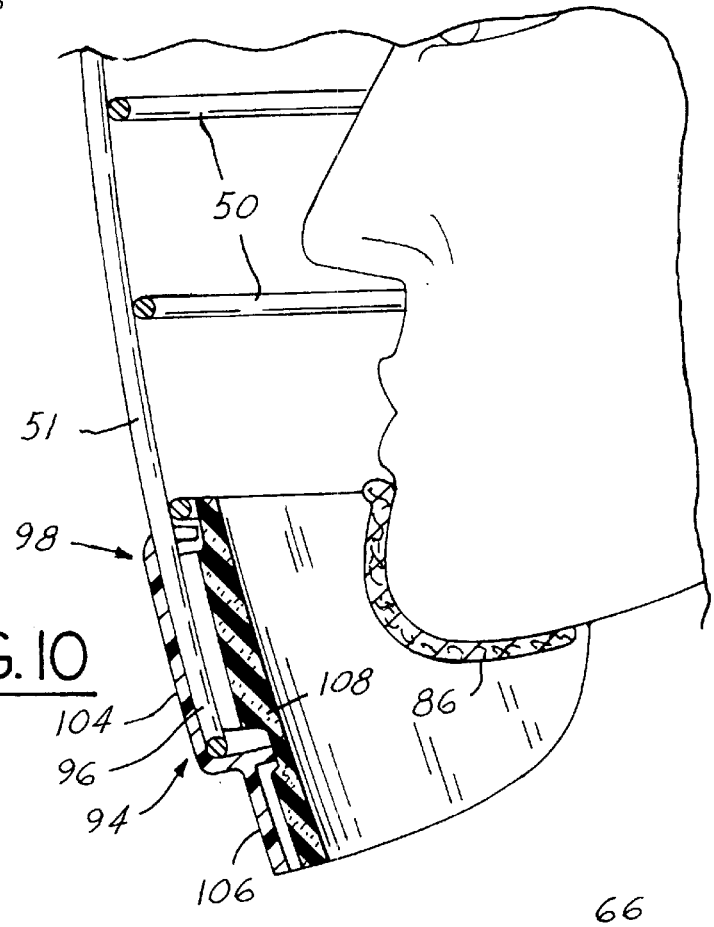
FIG. 10 is a cross-sectional view of the helmet mouthpiece and chinguard of FIG. 3 in the direction of the arrows labeled 10—10.

The helmet also includes a mouthpiece 94, which is best illustrated in FIGS. 1 through 3. The mouthpiece 94 is disposed at the bottom portion 96 of the face mask 18. The mouthpiece 94 is preferably secured to the face mask 18, as best shown in FIG. 9. The mouthpiece 94 is preferably comprised of an outer plastic portion 98. The outer plastic portion 98 includes a plurality of channels 100 formed therein for receipt of one or more of the plurality of vertical bars 52. The outer plastic portion 98 also includes a plurality of openings 102 formed therein to provide ventilation to a wearer as well as to allow the wearer to better communicate with others while wearing the helmet 10. The openings 102 are preferably formed in an upper portion 104 of the outer plastic portion 98. The outer plastic portion 98 includes a lower portion 106 extending downwardly from the upper portion 104. The mouthpiece 94 thus acts as an extension of the face mask 18 to provide additional protection to a wearer's face and chin.

The outer plastic portion 98 has an inner lining portion 108 secured to an inner side thereof. The inner lining portion 108 does not cover the openings 102. Further, the inner lining portion 108 is intended to provide additional cushion to protect a wearer's chin, which is not present in existing helmet designs. As shown in FIG. 9, a screw 110 is passed through the outer plastic portion 98 to secure the mouthpiece 94 to the face mask 18. A washer 112 is disposed between the head of the screw 110 and the outer plastic portion 98. A nut 114 is utilized against the inner lining portion 108 to secure the screw 110 in place. The screw 110 is passed through one of the openings 54 formed in the face mask 18 between the bars 50, 52. It will be understood that a variety of other suitable attachment or securing mechanism can be utilized.

While particular embodiments of the invention have been shown and described, numerous variations and alternate embodiments will occur to those skilled in the art. Accordingly, it is intended that the invention be limited only in terms of the appended claims.

What is claimed is:

1. A protective sport helmet comprising:

a hard outer shell portion constructed to provide protection to a wearer's head;

an inner lining portion secured to an inner side of said hard shell portion;

a chin strap portion for attachment to said hard shell portion;

a ledge portion extending forwardly from said hard shell portion a visor portion secured to said hard shell portion and overlying said ledge portion; and a facemask portion secured to said hard shell portion and said ledge portion.

2. The helmet of claim 1 wherein said hard outer shell portion is constructed of a plastic material.

3. The helmet of claim 2 wherein said hard outer shell portion includes an upper crown portion, which is intended to be located over said wearer's head, and a lower portion extending generally downwardly therefrom.

4. The helmet of claim 3 wherein a ridge is formed between said upper crown portion and said lower portion.

5. The helmet of claim 1 wherein said hard outer shell portion has three elongated ear holes formed therein.

6. The helmet of claim 1 wherein said facemask includes a mouth piece attached to a bottom portion thereof to provide protection for a wearer's chin.

7. The helmet of claim 1 further comprising a plurality of raised attachment point disposed on said outer shell portion for connection of said chin strap portion.

8. The helmet of claim 1 wherein said outer shell portion includes a forward edge that extends generally between a bottom edge and said ledge portion, an upper end of said forward edge being disposed more rearward than a lower end of said forward edge to allow increased peripheral vision for said wearer.

9. The helmet of claim 1 wherein said lining portion is constructed of multiple layers.

10. The helmet of claim 9, wherein said lining portion includes a rigid lining portion that is secured to said inner surface of said hard shell portion.

11. The helmet of claim 10 wherein said lining portion includes a soft liner disposed proximate to said wearer's head to provide increased comfort.

12. The helmet of claim 11 wherein said soft liner is constructed of a laminate.

13. The helmet of claim 1 wherein said inner lining portion has a crown layer portion that is removable from the hard outer shell portion to allow for adjustability of the size of the helmet.

14. The helmet of claim 1 wherein said inner lining portion has an end portion that wraps around a bottom edge of said hard outer shell portion and is secured to an outer surface thereof to protect the base of said wearer's neck.

* * * * *